US006709569B2

(12) United States Patent
Moore, Jr. et al.

(10) Patent No.: US 6,709,569 B2
(45) Date of Patent: Mar. 23, 2004

(54) METHODS FOR PRE-CONDITIONING FISCHER-TROPSCH LIGHT PRODUCTS PRECEDING UPGRADING

(75) Inventors: Richard O. Moore, Jr., San Rafael, CA (US); Paul D. Cambern, Martinez, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 182 days.

(21) Appl. No.: 10/023,876

(22) Filed: Dec. 21, 2001

(65) Prior Publication Data

US 2003/0119924 A1 Jun. 26, 2003

(51) Int. Cl.[7] ..... C10G 47/00; C10G 71/00; C10G 35/04; C10G 45/00; C10L 1/04

(52) U.S. Cl. ..... 208/58; 208/15; 208/18; 208/64; 208/107; 208/210; 585/14

(58) Field of Search ..... 208/58, 15, 18, 208/210, 64, 107; 585/14

(56) References Cited

U.S. PATENT DOCUMENTS

| | | | | |
|---|---|---|---|---|
| 3,172,836 A | | 3/1965 | Robbers | |
| 4,385,193 A | | 5/1983 | Bijwaard et al. | |
| 4,568,663 A | | 2/1986 | Mauldin | |
| 4,594,468 A | | 6/1986 | Minderhoud et al. | |
| 4,615,796 A | | 10/1986 | Kramer | |
| 5,603,824 A | | 2/1997 | Kyan et al. | |
| 6,087,544 A | * | 7/2000 | Wittenbrink et al. | 585/14 |
| 6,096,190 A | | 8/2000 | Cash | |
| 6,179,995 B1 | | 1/2001 | Cash et al. | |
| 6,200,462 B1 | | 3/2001 | Cash et al. | |
| 6,224,747 B1 | | 5/2001 | Cash et al. | |
| 6,225,359 B1 | | 5/2001 | O'Rear et al. | |
| 6,310,108 B1 | | 10/2001 | Bonneau et al. | |
| 6,331,573 B1 | | 12/2001 | Kibby | |
| 6,583,186 B2 | * | 6/2003 | Moore et al. | 518/700 |

FOREIGN PATENT DOCUMENTS

| | | |
|---|---|---|
| EP | 515 256 | 11/1992 |
| EP | 583 836 | 2/1994 |
| EP | 609 079 | 8/1994 |
| EP | 668 342 | 8/1995 |
| EP | 921 295 | 6/1999 |
| WO | WO 99/47626 | 9/1999 |
| WO | WO03/018517 | 3/2003 |

* cited by examiner

*Primary Examiner*—J. Parsa
(74) *Attorney, Agent, or Firm*—Burns, Doane, Swecker & Mathis, L.L.P.

(57) ABSTRACT

Embodiments of the present invention are directed to methods for hydroprocessing Fischer-Tropsch products. The embodiments in particular are related to integrated methods for producing liquid fuels from a hydrocarbon stream provided by a Fischer-Tropsch synthesis process. The methods involves separating the Fischer-Tropsch products into a light fraction and a heavy fraction. The light fraction is preconditioned to remove contaminants such as $CO_2$ prior to being subjected to hydroprocessing, either separately, or after having been being recombined with the heavy fraction. Any of the hydroprocessing steps may be accomplished in a single reactor.

41 Claims, 4 Drawing Sheets

METHODS FOR PRE-CONDITIONING FISCHER-TROPSCH LIGHT PRODUCTS PRECEDING UPGRADING

BACKGROUND

The majority of combustible liquid fuel used in the world today is derived from crude oil. However, there are several limitations to using crude oil as a fuel source, many of which relate to environmental impacts of burning nitrogen-, sulfur-, and aromatic-containing fuels. Alternative sources for developing combustible liquid fuels are desirable. One such source that is in abundant supply is natural gas. The conversion of natural gas to combustible liquid fuel typically involves converting the natural gas, which is mostly methane, to synthesis gas, also called syngas, which is a mixture of carbon monoxide and hydrogen. An advantage of using fuels prepared from syngas is that they typically do not contain appreciable amounts of nitrogen and sulfur and generally do not contain aromatic compounds. Accordingly, they have less environmental impact than conventional petroleum-based fuels. Fischer-Tropsch synthesis is a preferred means for converting syngas to higher molecular weight hydrocarbon products.

The present invention is directed toward a process for reducing the impact of by-products produced during a Fischer-Tropsch (FT) synthesis process. Carbon oxides (e.g. carbon monoxide and carbon dioxide) are created both in the production of syngas and as a result of a Fischer-Tropsch hydrocarbon synthesis process. While CO is a reactant in the Fischer-Tropsch process, both CO and $CO_2$ are present in the Fischer-Tropsch products. Light Fischer-Tropsch hydrocarbon fractions recovered especially from slurry bed Fischer-Tropsch reactors contain significant quantities of carbon oxides. These carbon oxides, when allowed to remain in the Fischer-Tropsch light hydrocarbon fraction, can consume significant amounts of $H_2$ during downstream hydroprocessing; reduce $H_2$ partial pressure and cause rapid catalyst fouling during downstream hydroprocessing (due to the high amounts of diluent carbon oxide gases in recycle gas systems); acidify reactor effluents, especially water (which requires expensive equipment metallurgy); and foul catalytic hydrogenation metals, especially noble metals. Therefore, an object of this invention is to remove carbon oxides and other components at appropriate points in the processing.

SUMMARY OF THE INVENTION

The present process removes methane as well as carbon oxides, which reduces equipment costs in down stream processing and reduces the diluent effect of methane in recycle gas streams. The present process provides a method for pre-conditioning Fischer-Tropsch light products in general prior to upgrading, and particularly provides a process for pre-conditioning light Fischer-Tropsch slurry bed reaction synthesis hydrocarbon products prior to upgrading, the advantages of which will be apparent.

Embodiments of the present invention are directed toward a process for pre-conditioning light Fischer-Tropsch slurry bed reactor synthesis hydrocarbon products prior to upgrading in a hydroprocessing unit. According to these embodiments, certain components of the light hydrocarbon product are removed since they are detrimental to downstream hydroprocessing equipment, catalysts, and operating economics. Embodiments of the present invention are directed toward a method for removing and optionally recovering $CO_2$ contained in products from a Fischer-Tropsch synthesis process. An exemplary process comprises:

(a) isolating a light fraction and a heavy fraction from a Fischer-Tropsch synthesis product;

(b) separating the light fraction into a carbon oxide-containing gaseous fraction and a treated light fraction;

(c) subjecting the treated light fraction to hydroprocessing step to yield a light effluent; and (d) recovering hydrocarbons, liquid fuels, and other useful products from the effluent of the hydroprocessing step.

In this exemplary embodiment of the process, carbon oxides (i.e. $CO_2$ and CO) contained in a light fraction from the Fischer-Tropsch synthesis process are separated from the hydrocarbons in the light fraction, preferably by stripping, distillation or fractionation. A gaseous stream from the separation step includes greater than 75% v/v, preferably greater than 85% v/v, and more preferably greater than 95% v/v of the of the carbon oxides contained in the light fraction. This gaseous stream may include minor amount of hydrocarbons, where methane is typically the dominant hydrocarbon component. Preferably, the gaseous fraction comprises greater than 50 percent by weight carbon oxides. A treated light fraction from the separation step (b) contains trace amounts of carbon oxides, preferably less than 500 ppm, more preferably less than 100 ppm, and most preferably less than 50 ppm. Preferably, the gaseous stream from the separation step contains less than 15 percent by weight $C_2$–$C_4$ hydrocarbons.

At least a portion of the treated light fraction recovered from the separating step (b) may be further converted to meet the needs of a particular process. Exemplary additional processing steps may include dehydrogenation to produce aromatics and/or gasoline, thermal or steam cracking to produce olefins such as ethylene, hydrocracking for molecular weight reduction, hydrotreating to remove olefins and oxygenates, hydroisomerization to form low pour point isoparaffins, catalytic dewaxing for wax removal and pour point reduction, and hydrofinishing for improving product stability. In a preferred embodiment, a light fraction having an distillation endpoint (EP) in the range of 650–750° F. and a heavy fraction having an initial boiling point (IBP) in the range of 650–750° F. are recovered from the Fischer-Tropsch synthesis process. These products, either in combination or singly, may be hydroprocessed to prepare fuels and/or lubricating oil base stocks.

Among other factors, embodiments of the present invention are based on the discovery of a process for treating Fischer-Tropsch synthesis products to remove carbon oxides to very low levels with little or no loss of hydrocarbon product. The process effectively separates the carbon oxides from the light hydrocarbons, the latter of which are then further processed for making or blending into fuels and, optionally, lubricating oils. Advantages of the present process include improved yields of valuable products from a Fischer-Tropsch synthesis process. Embodiments of the present invention provide methods for removing and optionally recovering carbon oxides, particularly $CO_2$, in the form of a substantially purified stream for disposal if desired.

DETAILED DESCRIPTION OF THE INVENTION

Figure 1:
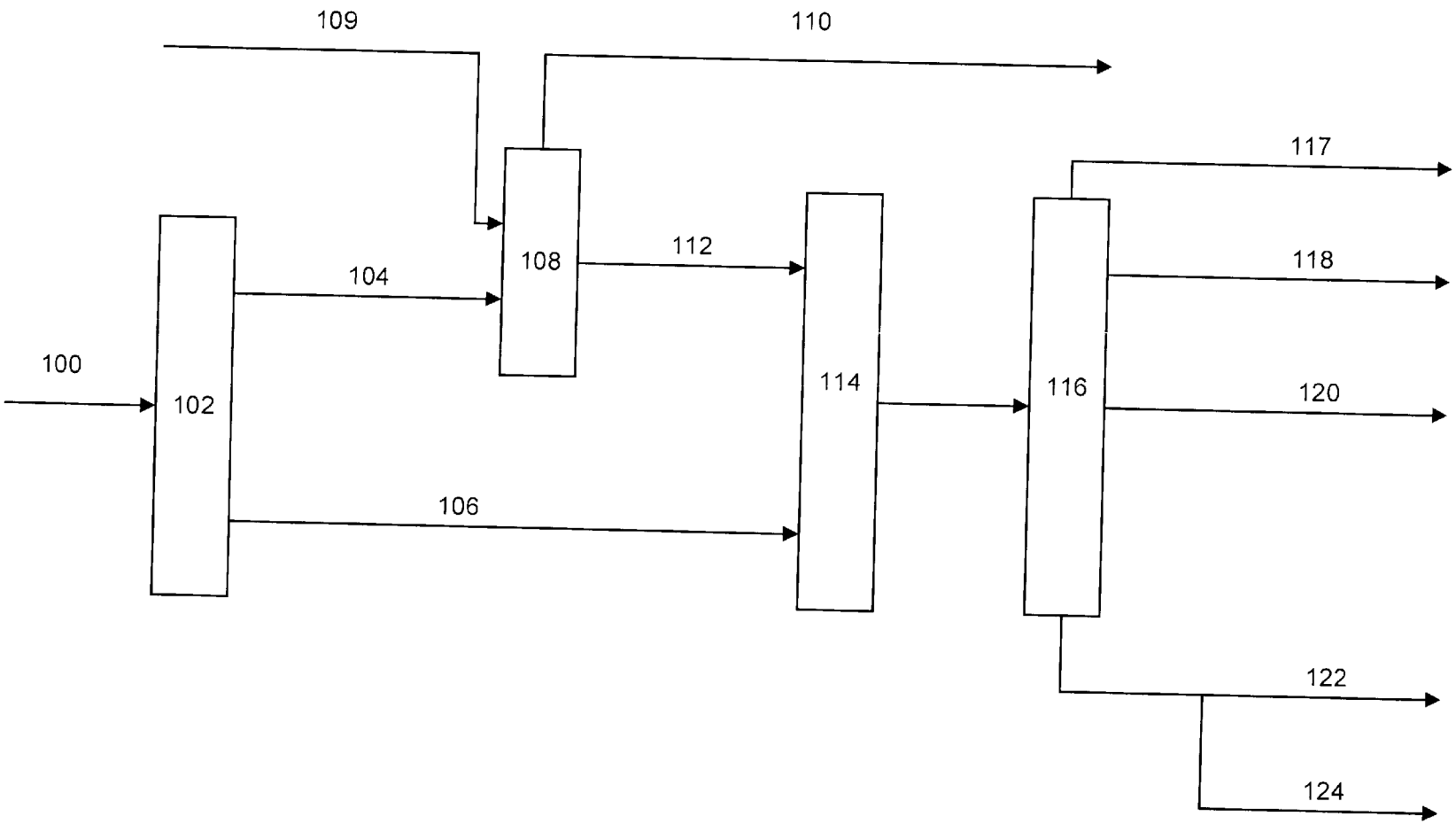
FIG. 1 is a flowchart illustrating an overview of various embodiments of the present invention, in which a light fraction of products from a Fischer-Tropsch (FT) synthesis process is passed through a stripper to remove carbon oxide components, forming a treated light fraction.

Embodiments of the present invention are directed toward a method for hydroprocessing Fischer-Tropsch products. Certain embodiments in particular relate to an integrated method for producing liquid fuels from a hydrocarbon stream provided by Fischer-Tropsch synthesis, which in turn involves the initial conversion of a light hydrocarbon stream to syngas and subsequent conversion of that syngas to higher molecular weight hydrocarbon products.

According to aspects of the present invention, the products from a Fischer-Tropsch process are separated into a light fraction and a heavy fraction (or, alternatively, obtaining such fractions from an appropriate source). The light fraction is subjected to preconditioning whereby undesired components such as $CO_2$ are removed to yield a treated stream. The treated stream is then (either separately or after recombination with the heavy fraction) hydroprocessed to produce desired products.

It has been demonstrated that the full range of Fischer-Tropsch synthesis products ($C_{3-}$) and/or streams can be successfully co-hydroprocessed or simultaneously hydroprocessed to high yield of desired middle-distillate products without requiring segregation or processing in a series flow scheme. This innovation allows for a significant economic advantage since an entire Fischer-Tropsch $C_{3+}$ stream can be processed in a single step in a single reactor without any primary or intermediate separation, except for the removal of carbon oxides as described earlier.

More particularly, it has been found that the lighter Fischer-Tropsch fraction (condensate) which already boils in the desired middle-distillate range can be processed such that the olefins, nitrogen and oxygenates are selectively removed and sufficient isomerization takes place to provide the desired cold flow properties of the fuel, with reduced overcracking to light products ($C_{4-}$ and naphtha). In the same reactor, and over the same catalyst system (one or more catalyst types), the Fischer-Tropsch wax is hydrocracked at the same time, and isomerized to produce a high yield of middle-distillate with good burning characteristics (high cetane number) and desired cold flow properties.

The inventive process is most preferably carried out in a single reactor, multi-bed, extinction recycle hydrocracker with either sulfided base-metal or non-sulfided noble-metal hydrocracking catalyst either with or without molecular sieve components.

Definitions

As used herein, the following terms have the following meanings:

The term "light hydrocarbon feedstock" refers to feedstocks that can include methane, ethane, propane, butane and mixtures thereof. In addition, carbon dioxide, carbon monoxide, ethylene, propylene and butanes may be present.

The term "light fraction" refers to a fraction in which at least 75 percent by weight, more preferably 85 percent by weight, and most preferably at least 90 percent by weight of the components have a boiling point in the range of about 50 to 700° F. A light fraction includes predominantly components having carbon numbers in the range of 3 to 20, i.e. $C_3$–$C_{20}$. In a particular embodiment, a light fraction includes at least 0.1 percent by weight oxygenates.

The term "heavy fraction" refers to a fraction in which at least 80 percent by weight, more preferably 85 percent by weight, and most preferably at least 90 percent by weight of the components have a boiling point higher than 650° F. A heavy fraction may include predominantly $C_{20+}$ components. In a preferred embodiment, the heavy fraction includes at least 80 percent by weight paraffins and, more preferably, no more than about 1 percent by weight oxygenates.

The term "650° F.+ containing product stream" refers to a product stream that includes greater than 75 percent by weight compounds boiling at 650° F. or greater ("650° F.+ material"), preferably greater than 85 percent by weight 650° F.+ material, and, most preferably, greater than 90 percent by weight 650° F.+ material as determined by ASTM D2887 or other suitable methods. The term "650° F.– containing product stream" is similarly defined.

The term "paraffin" refers to a hydrocarbon with the formula $C_nH_{2n+2}$.

The term "olefin" refers to a hydrocarbon having at least one carbon-carbon double bond.

The term "oxygenate" refers to a hydrocarbonaceous compound that includes at least one oxygen atom.

The term "distillate fuel" refers to a material containing hydrocarbons with boiling points between about 60 and 800° F. The term "distillate" means that typical fuels of this type can be generated from vapor overhead streams from the distillation of petroleum crude. In contrast, residual fuels cannot be generated from vapor overhead streams by distilling petroleum crude, and thus residual fuels constitute a non-vaporizable remaining portion. Within the broad category of distillate fuels are specific fuels that include naphtha, jet fuel, diesel fuel, kerosene, aviation gas, fuel oil, and blends thereof.

The term "diesel fuel" refers to a material suitable for use in diesel engines, and conforming to one of the following specifications:

- ASTM D-975—"Standard Specification for Diesel Fuel Oils";
- European Grade CEN 90;
- Japanese Fuel Standards JIS K 2204;
- The United States National Conference on Weights and Measures (NCWM) 1997 guidelines for premium diesel fuel; and
- The United States Engine Manufacturers Association recommended guideline for premium diesel fuel (FQP-1A).

The term "jet fuel" refers to a material suitable for use in turbine engines such as those found, for example, in aircraft, or in other applications regulated by one of the following specifications:

- ASTM D-165;
- DEF STAN 91-91/3 (DERD 2494), TURBINE FUEL, AVIATION, KEROSINE TYPE, JET A-1, NATO CODE: F-35; and International Air Transportation Association (IATA) Guidance Materials for Aviation, 4th edition, March 2000.

The term "hydrotreating" refers to a process whereby a refinery stream is catalytically treated with hydrogen gas ($H_2$) to reduce the content of undesirable sulfur and nitrogen containing compounds, and to stabilize the feed. (The term "stabilization" refers to a process of converting unsaturated hydrocarbons such as olefins to saturated compounds, such as paraffins). The use of cobalt-molybdenum catalysts are typically selected for removing sulfur compounds; similarly, nickel-molybdenum catalysts are preferred for removing nitrogen containing compounds and for saturating aromatic ring structures.

The term "hydrocracking" refers to a process where the overall objective is to reduce the boiling point ranges of the components of the feed relative to the feed itself. Since the hydrocracking catalyst is usually susceptible to poisoning by metallic salts and sulfur and nitrogen containing compounds, it is generally preferred to hydrotreat the feed prior to hydrocracking. Hydrocracking may be thought of as a catalytic cracking process with an accompanying hydrogenation reaction to saturate olefins to paraffins.

The term "hydroprocessing" refers to a process wherein both hydrotreating and hydrocracking processes occur; in other words, undesirable sulfur and nitrogen containing compounds are removed from the feed, while concurrently, the boiling point ranges of the products of the hydroprocessing reaction are substantially reduced relative to the boiling point range of the feed itself.

Natural Gas as a Feedstock for Syngas Generation

Natural gas is an example of a light hydrocarbon feedstock. In addition to methane, natural gas includes some heavier hydrocarbons (mostly $C_{2-5}$ paraffins) and other impurities, e.g., mercaptans and other sulfur-containing compounds, carbon dioxide, nitrogen, helium, water and non-hydrocarbon acid gases. Natural gas fields also typically contain a significant amount of $C_{5+}$ material, which is a liquid at ambient conditions.

The methane, and optionally ethane and/or other hydrocarbons, can be isolated and used to generate syngas. Various other impurities can be readily separated. Inert impurities such as nitrogen and helium can be tolerated. The methane in the natural gas can be isolated in a demethanizer for example, de-sulfurized, and then sent to a syngas generator.

Syngas as a Feedstock for a Fischer-Tropsch Process

Methane (and/or ethane and heavier hydrocarbons) can be sent through a conventional syngas generator to provide synthesis gas. Typically, synthesis gas (optionally called "syngas") comprises hydrogen and carbon monoxide, but may also include minor amounts of carbon dioxide, water, unconverted light hydrocarbon feedstock components, and various other impurities. The presence of sulfur, nitrogen, halogen, selenium, phosphorus, and arsenic containing contaminants in syngas is undesirable. For this reason, sulfur and other contaminants are preferably removed from the feed before performing a Fischer-Tropsch process or other hydrocarbon synthesis. Processes for removing these and other contaminants are well known to those of skill in the art. For example, ZnO guard beds are preferred for removing sulfur impurities.

Distillate Products

Middle distillate fractions as described herein boil in the range of about 250 to 700° F. (about 121 to 371° C.) as determined by the appropriate ASTM test procedure. The term "middle distillate" is intended to include the diesel, jet fuel and kerosene boiling range fractions. The kerosene or jet fuel boiling point range is intended to refer to a temperature range of about 280 to 525° F. (138 to 274° F.) and the term "diesel boiling range" is intended to refer to hydrocarbon boiling points of about 250 to 700° F. (121 to 371° F.). Gasoline or naphtha is normally the $C_5$ to 400° F. (204° C.) endpoint fraction of available hydrocarbons. The boiling point ranges of the various product fractions recovered in any particular refinery or synthesis process will vary with such factors as the characteristics of the source, local market conditions or requirements, product prices, etc. Reference is made to ASTM standards D-975, D-3699-83 and D-3735 for further details on kerosene, diesel and naphtha fuel properties.

Fischer-Tropsch Synthesis

Catalysts and conditions for performing Fischer-Tropsch synthesis are well known to those of skill in the art, and are described, for example, in EP 0 921 184 A1, the contents of which are hereby incorporated by reference in their entirety. In the Fischer-Tropsch synthesis process, liquid and gaseous hydrocarbons are formed by contacting a synthesis gas (syngas) comprising a mixture of $H_2$ and CO with a Fischer-Tropsch catalyst under suitable temperature and pressure reactive conditions. The Fischer-Tropsch reaction is typically conducted at temperatures of about 300 to 700° F. (149 to 371° C.), preferably about from 400 to 550° F. (204 to 228° C.); pressures of about 10 to 600 psia (0.7 to 41 bars), preferably 30 to 300 psia (2 to 21 bars) and catalyst space velocities of about 100 to 10,000 cc/g/hr., preferably 300 to 3,000 cc/g/hr. The products of a Fischer-Tropsch process may range from $C_1$ to $C_{200+}$, with a majority of the products in the $C_5$–$C_{100+}$ range.

A Fischer-Tropsch synthesis reaction may be conducted in a variety of reactor types including, for example, fixed bed reactors containing one or more catalyst beds, slurry reactors, fluidized bed reactors, or a combination of different type reactors. Such reaction processes and reactors are well known and documented in the literature. A preferred process according to embodiments of the present invention is the slurry Fischer-Tropsch process, which utilizes superior heat and mass transfer techniques to remove heat from the reactor, since the Fischer-Tropsch reaction is highly exothermic. In this manner, it is possible to produce relatively high molecular weight, paraffinic hydrocarbons.

In a slurry process, a syngas comprising a mixture of $H_2$ and CO is bubbled up as a third phase through a slurry formed by dispersing and suspending a particulate Fischer-Tropsch catalyst in a liquid comprising hydrocarbon products of the synthesis reaction. Accordingly, the hydrocarbon products are substantially in liquid form at the reaction conditions. The mole ratio of the hydrogen to the carbon monoxide may broadly range from about 0.5 to 4, but is more typically within the range of about 0.7 to 2.75, and preferably from about 0.7 to 2.5. A particularly preferred Fischer-Tropsch process is taught in EP 0 609 079, also completely incorporated herein by reference.

Suitable Fischer-Tropsch catalysts comprise one or more Group VIII catalytic metals such as Fe, Ni, Co, Ru, and Re. Additionally, a suitable catalyst may contain a promoter. Thus, a preferred Fischer-Tropsch catalyst comprises effective amounts of cobalt and one or more of the elements Re, Ru, Pt, Fe, Ni, Th, Zr, Hf, U, Mg, and La on a suitable inorganic support material, preferably a material which comprises one or more of the refractory metal oxides. In general, the amount of cobalt present in the catalyst is between about 1 and about 50 percent by weight of the total catalyst composition. The catalysts can also contain basic oxide promoters such as $ThO_2$, $La_2O_3$, MgO, and $TiO_2$, promoters such as $ZrO_2$, noble metals such as Pt, Pd, Ru, Rh, Os, Ir, coinage metals such as Cu, Ag, and Au, and transition metals such as Fe, Mn, Ni, and Re. Support materials including alumina, silica, magnesia and titania or mixtures thereof may also be used. Preferred supports for cobalt containing catalysts comprise titania. Exemplary catalysts and their preparation may be found, among other places, in U.S. Pat. No. 4,568,663.

Product Isolation from a Fischer-Tropsch Synthesis

In exemplary embodiments of the present invention, a light fraction (also called a condensate fraction, or a light liquid fraction) and a heavy fraction (also called a waxy fraction) are isolated from the products of a Fischer-Tropsch reaction product. The light liquid reaction product includes hydrocarbons boiling below about 700° F. (e.g., tail gases through middle distillates, with increasingly smaller amounts of material up to about $C_{30}$), with a preferable boiling range of about $C_3$ to 650° F. The waxy reaction product includes hydrocarbons boiling above about 600° F. (e.g., vacuum gas oil through heavy paraffins with increasingly smaller amounts of material down to about $C_{10}$).

Overview of Exemplary Embodiments of the Present Invention

An overview of exemplary embodiments of the present invention are illustrated in FIG. 1. Referring to FIG. 1, a syngas feed 100 is delivered to a Fischer-Tropsch synthesis process 102 which may produce an output stream that includes a light fraction 104 and a heavy fraction 106. The light fraction 104 is treated in a vessel 108 for stripping carbon oxides such as $CO_2$ and CO from the light fraction 104; the vessel is supplied with a stripping medium and/or heat source 109. Optionally, light hydrocarbons that do not contribute to plant product yields may be removed from the light fraction 104 as well. After the carbon oxides are removed as a gaseous fraction 110, a treated light fraction 112 results.

According to embodiments of the present invention, the heavy fraction 106 and the treated light fraction 112 are then subjected to various hydrotreating and hydrocracking zones (which may be collectively called a hydroprocessing zone) 114. The effluent from the hydroprocessing reaction zone 114 is then passed to a separation process 116, and the hydrogen-containing gases 117, light hydrocarbons 118, fuels 120, and recovered heavy products 122 are collected after separation. In a slight modification of one embodiment, stream 124 from the recovered heavy products 122 may be sent to be processed into a lubricating oils fraction.

Pre-Conditioning of the Light Fraction from a Fischer-Tropsch Synthesis

The portion of the process that removes undesired components from the light fraction 104 to yield a treated-light fraction 112 will now be described in more detail. The light fraction described above is treated ("pre-conditioned") to remove certain components therein that are detrimental to downstream hydroprocessing equipment and catalysts, as well as operating economics. In addition to the problems created by the presence of carbon oxides, such as $CO_2$, light hydrocarbons that do not materially contribute to plant product yields may exacerbate certain equipment problems, and thus these light hydrocarbons may also be removed if desired. Preferred methods of removing the undesired carbon oxide compounds and/or other components include, for example, stripping processes such as reboiling, steam stripping, and gas stripping, each process of which is known to those skilled in the art. Typically, sufficient amounts of carbon oxides are removed to reduce the $CO_2$ level in the treated-light fraction stream to within a range of about 1 to 500 ppm, and preferably to within a range of about 10 to 100 ppm.

An exemplary vessel suitable for removing $CO_2$ from the light fraction is configured to pass the light fraction in a countercurrent direction relative to a flowing vapor stream, wherein the vapor stream may comprise steam, nitrogen, hydrogen, methane or other light hydrocarbons, and the like. When vapor streams of this type are used for stripping $CO_2$ from the light fraction, the $CO_2$ content of the resulting carbon oxide-containing gaseous fraction will be diluted by the added stripping vapor. When determining the effectiveness of removing the $CO_2$ according to the invention, the $CO_2$ concentration in the gaseous fraction is based on a diluent-free basis. Such a determination is well within the skill of one knowledgeable in the art.

Another exemplary vessel for removing $CO_2$ from the light fraction is heating by, for example, an electrical heat source, a thermal heat source, a hot condensable vapor from a reboiler, or some other source of heat.

In order to minimize the quantities of liquefied petroleum gas (LPG) which are removed from the light fraction during the pre-conditioning (carbon oxide separation) step, it is preferred to operate the pre-conditioning step at pressures above about atmospheric pressure. An exemplary operating pressure is greater than about 5 bar, with the maximum pressure being set by the specifications of the vessel used in the separation process.

Additional Hydrocarbon Streams

The light and heavy fractions described above can optionally be combined with hydrocarbons from other streams, for example, streams from petroleum refining and condensate from well gas separation. The light fractions can be combined with similar fractions obtained from the fractional distillation of crude oil. The heavy fractions can be combined with waxy crude oils, crude oils and/or slack waxes from petroleum de-oiling and de-waxing operations.

Optional Preparation of the Light Fraction Before Hydrotreatment

The light fraction typically includes a mixture of hydrocarbons, including mono-olefins and alcohols. The mono-olefins are typically present in an amount of at least about 5.0 percent by weight of the fraction. The alcohols are usually present in an amount typically of at least about 0.5 percent by weight or more.

The light fraction may be transported to and introduced at a position in the hydroprocessing reactor which is below the last hydrocracking bed and is above or within the hydrotreatment beds having temperatures greater than about 200° C. Prior to introduction, the light fraction is heated and/or pressurized and is preferably mixed with a hydrogen-containing gas stream.

The source of hydrogen may be virtually any hydrogen-containing gas that does not include significant amounts of impurities that would adversely affect the hydrotreatment catalysts. In particular, the hydrogen-containing gas includes sufficient amounts of hydrogen to achieve the desired effect, and may include other gases that are not harmful to the formation of desired end products and that do not promote or accelerate fouling of the downstream catalysts and hydrotreatment equipment. Examples of possible hydrogen-containing gases include hydrogen gas and syngas. The hydrogen may originate from a hydrogen plant, a recycle gas source in a hydroprocessing unit, or similar such sources. Alternatively, the hydrogen-containing gas may comprise a portion of the hydrogen used in hydrocracking the heavy fraction.

After the hydrogen-containing gas is introduced into the fraction, the fraction can be pre-heated, if necessary, in a heat exchanger. The methods of heating the fractions in the heat exchangers can include any methods known to practitioners in the art. For example, a shell and tube heat exchanger may be used, wherein a heated substance, such as steam or a reaction product from elsewhere in the method, is fed through an outer shell, providing heat to the fraction in an inner tube, thus heating the fraction and cooling the heated substance in the shell. Alternatively, the fraction may be heated directly by passing the fraction through a heated tube, wherein the heat may be supplied by electricity, combustion, or any other source known to practitioners in the art.

Hydroprocessing Reactors

Exemplary embodiments of the present method will now be described in the context of a hydroprocessing reactor. Preferably, the reactor is a downflow reactor that includes at least one catalyst bed. Multiple catalyst beds will generally be equipped with inter-bed redistributors between the beds.

Figure 2:
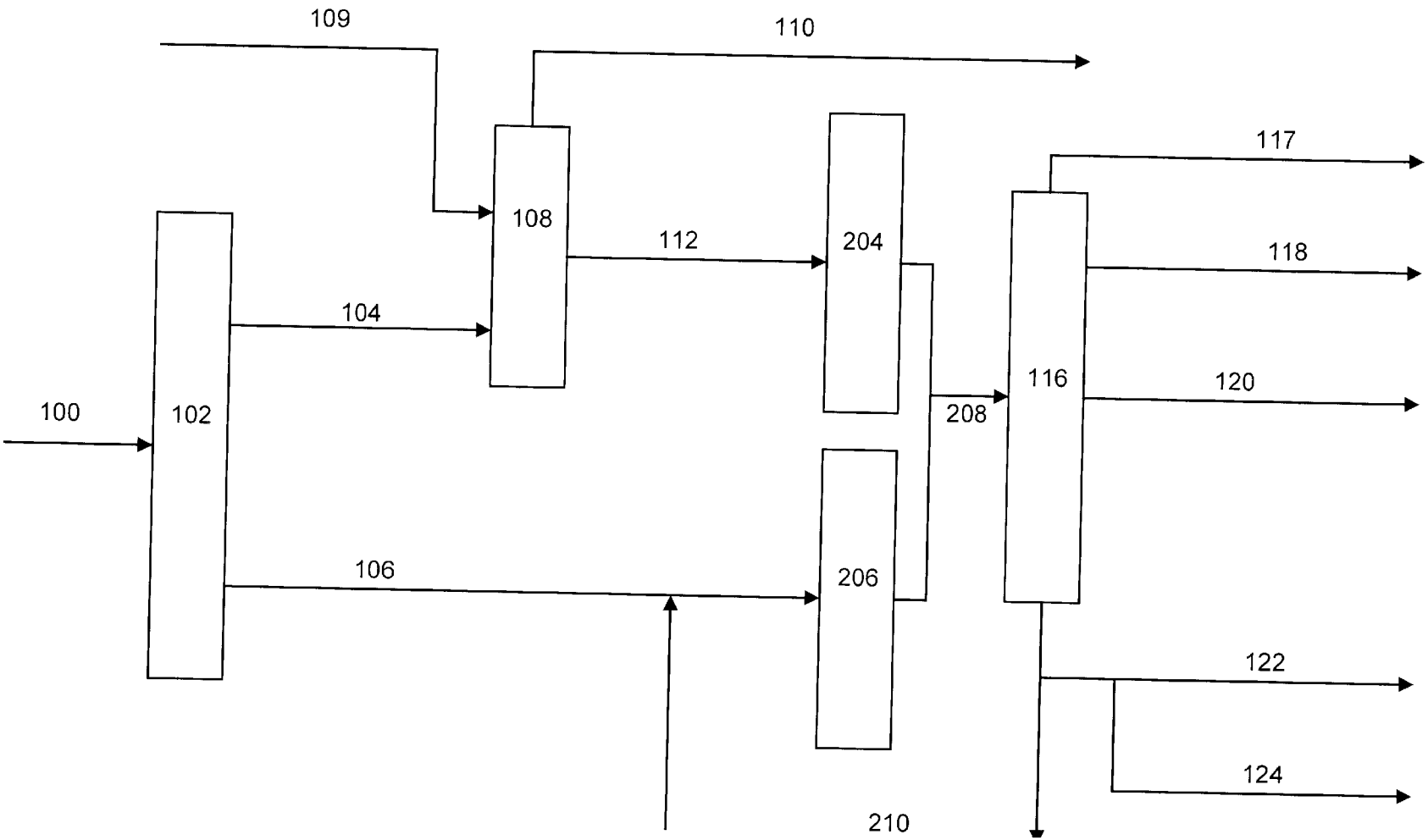
FIG. 2 is a flowchart illustrating a first embodiment of the present invention, in which the heavy fraction from the Fischer-Tropsch synthesis process is passed to a hydrocracking reaction zone, and the treated light fraction from the Fischer-Tropsch synthesis process is passed to a hydrotreating reaction zone.

Referring to FIG. 2, a first embodiment of the present method is described wherein the treated light fraction 112 from the Fischer-Tropsch synthesis 102 is passed to a hydrotreating process 204, and the heavy fraction 106 from the Fischer-Tropsch synthesis 102 is passed to a hydrocracking process 206. The effluent from the hydrocracking process 206 and the hydrotreating process 204 is then blended (indicated by reference numeral 208 in FIG. 2) before being sent to the separation process 116. As in each of the embodiments, the hydrogen-containing gases 117, light hydrocarbons 118, fuels 120, and recovered heavy products 122 are collected after the separation step 116. Of course, it will be understood by those skilled in the art that the hydrotreating and hydrocracking processes 204 and 206, respectively, may be performed in different zones of the same reactor, or they may be done in different reactors.

Figure 3:
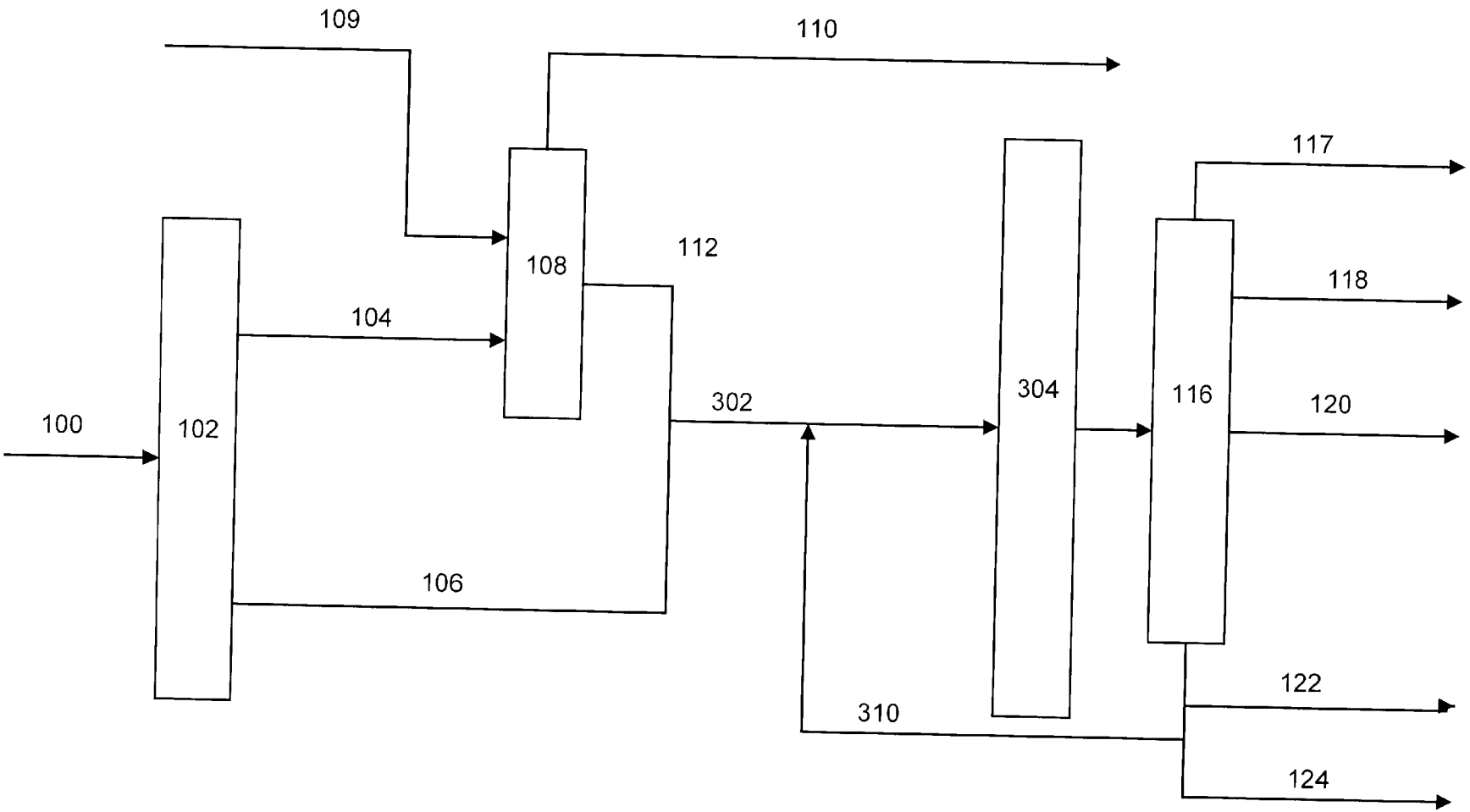
FIG. 3 is a flowchart illustrating a second embodiment of the present invention, in which the heavy fraction and the treated light fraction are combined before passing the blend to a hydroprocessing reaction zone, which may include separate hydrocracking and hydrotreating steps.

As indicated in FIG. 2, a heavy recycle portion 210 may be separated from the recovered heavy product stream 122 and returned to (and blended with) the heavy fraction flow 106, to be passed through the hydrocracking reactor 206 again. Optionally, at least a portion of hydrogen-containing gas 117 may be recycled to hydrotreating reactor 204 and/or hydrocracking reactor 206. A second embodiment of the present invention is illustrated in FIG. 3. In this embodiment, the treated-light fraction 112 and the heavy fraction 106 from the Fischer-Tropsch synthesis 102 are combined, as indicated by reference numeral 302, and the resulting blend is passed to a hydroprocessing step 304. The hydroprocessing step 304 may comprise one or more hydrocracking reaction steps or one or more hydrotreating steps or one or more hydroisomerization steps, or any combination thereof and in any order. As in the previous embodiment, the hydrogen-containing gases 117, light hydrocarbons 118, fuels 120, and recovered heavy products 122 are collected after the separation 116.

As indicated in FIG. 3, a heavy recycle portion 310 may be separated from the recovered heavy product 122 stream. The heavy recycle portion 310 may then be combined with the heavy/treated-light blend 302, to be passed through the hydroprocessing process 304 again. Optionally, at least a portion of hydrogen-containing gas 117 may be recycled to hydroprocessing step 304.

Figure 4:
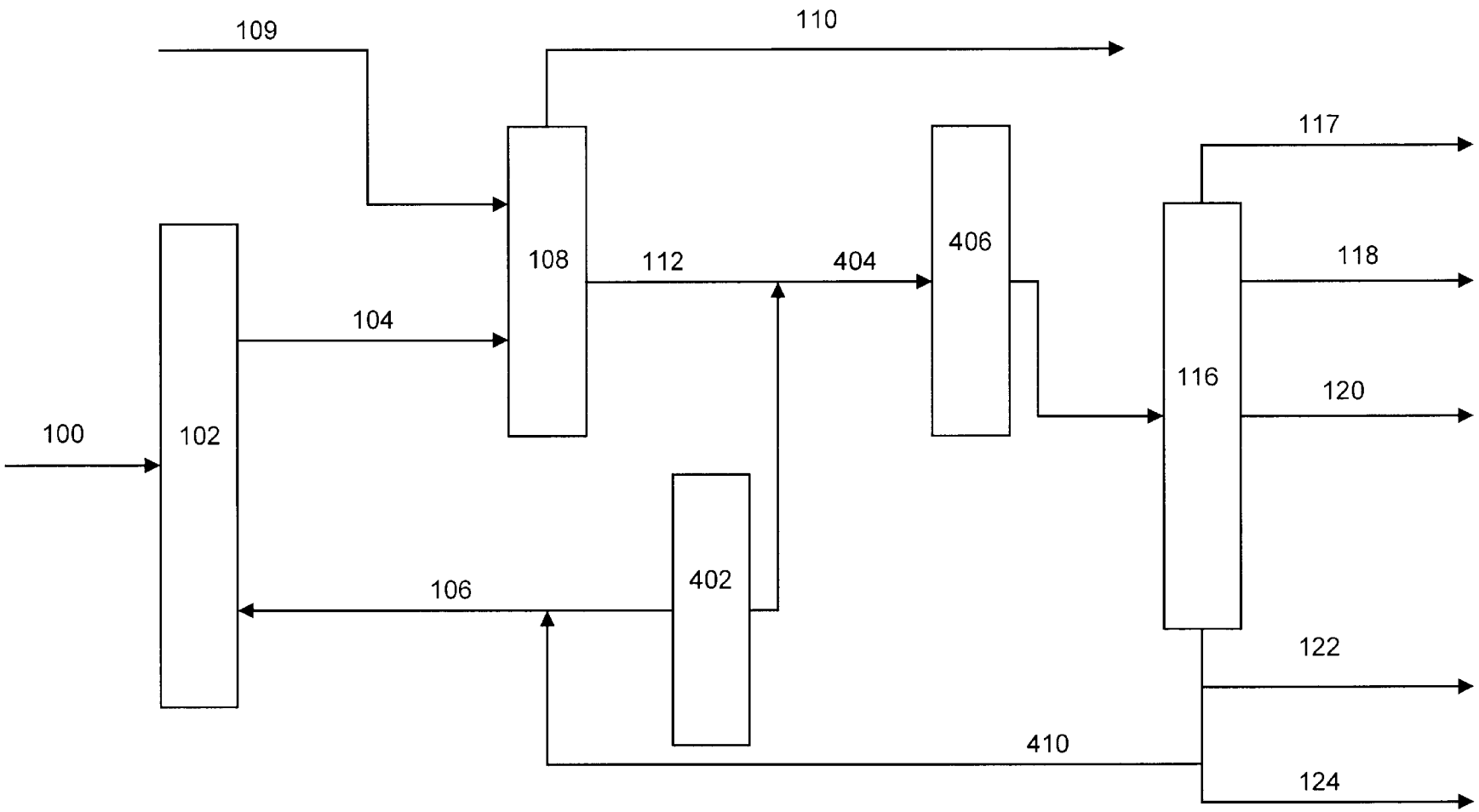
FIG. 4 is a flowchart illustrating a third embodiment of the present invention, in which the heavy fraction is passed to a hydrocracking reaction zone; the hydrocrackate effluent is combined with the treated light fraction, and the resulting blend is passed to a hydrotreating zone.

Referring to FIG. 4, a third embodiment is illustrated in which the heavy fraction 106 from the Fischer-Tropsch synthesis 102 is passed to a hydrocracking step 402 before being combined in a blend 404 with the treated-light fraction 112. The blend 404 is then passed to a hydrotreating step 406, and on to the separation step 116, as before, to produce hydrogen-containing gases 117, light hydrocarbons 118, fuels 120, and recovered heavy products 122. Stream 124 from the recovered heavy products 122 may be sent to be processed into a lubricating oils fraction.

Also indicated in FIG. 4 is a heavy recycle portion 410 that may be separated from the recovered heavy product 122 stream and then be combined with the heavy fraction 106 to be recycled through the hydrocracking reactor 402. Optionally, at least a portion of hydrogen-containing gas 117 may be recycled to one or both of hydrocracking reactor 402 and hydrotreating reactor 406. In these embodiments, the products of the hydrocracking reaction can be removed between beds, with continuing reaction of the remaining stream in subsequent beds. U.S. Pat. No. 3,172,836 discloses a liquid/vapor separation zone located between two catalyst beds for withdrawing a gaseous fraction and a liquid fraction from a first catalyst bed. Such techniques can be used if desired to isolate products. However, since the products of the hydrocracking reaction are typically gaseous at the reaction temperature, the residence time of the gaseous products on the catalyst beds is sufficiently low, and further hydrocracking of the product would be expected to be minimal, so product isolation is not required.

The catalysts and conditions for performing hydrocracking and hydrotreating reactions are discussed in more detail below.

Hydrocracking

According to embodiments of the present invention, the exemplary hydrocracking reaction zones 206, and 402 are maintained at conditions sufficient to effect a boiling range conversion of a vacuum gas oil (VGO) feed to the hydrocracking reaction zones such that the liquid hydrocrackate recovered from the hydrocracking reaction zones has a normal boiling point range below the boiling point range of the feed. Typical hydrocracking conditions include a reaction temperature range generally from about 400 to 950° F. (204 to 510° C.), and preferably about 650 to 850° F. (343 to 454° C.). A typical reaction pressure ranges from about 500 to 5000 psig (3.5 to 34.5 MPa), and preferably 1000–3500 psig (10.4–24.2 MPa). Typical liquid hourly space velocities (LHSV) range from about 0.1 to 15 $hr^{-1}$ (v/v), preferably 0.25–2.5 $hr^{-1}$. An exemplary rate of hydrogen consumption is about 300 to 2500 scf per barrel of liquid hydrocarbon feed (89.1 to 445 $m^3$ $H_2/m^3$ feed). The hydrocracking catalyst generally comprises a cracking component, a hydrogenation component and a binder. Such catalysts are well known in the art. The cracking component may include an amorphous silica/alumina phase and/or a zeolite, such as a Y-type or USY zeolite. The binder is generally silica or alumina. The hydrogenation component will be a Group VI, Group VII, or Group VIII metal or oxides or sulfides thereof, preferably one or more of molybdenum, tungsten, cobalt, or nickel, or the sulfides or oxides thereof. If present in the catalyst, these hydrogenation components generally make up from about 5 to 40 percent by weight of the catalyst. Alternatively, platinum group metals, especially platinum and/or palladium, may be present as the hydrogenation component, either alone or in combination with the base metal hydrogenation components molybdenum, tungsten, cobalt, or nickel. If present, the platinum group metals will generally make up from about 0.1 to 2 percent by weight of the catalyst.

Hydrotreatment

According to embodiments of the present invention, the exemplary hydrotreatment reaction zones 204 and 406 are maintained at conditions that include a reaction temperature generally between about 400 and 900° F. (204 to 482° C.), and preferably between about 650 and 850° F. (343 to 454° C.); a pressure generally between about 500 to 5000 psig (pounds per square inch gauge) (3.5 to 34.6 MPa), and preferably about 1000 to 3000 psig (7.0–20.8 MPa); a feed rate (LHSV, or volume of feed per hour per volume of catalyst) of 0.5 to 20 $hr^{-1}$ (v/v); and overall hydrogen consumption of from about 150 to 2000 scf (standard cubic feet) per barrel of liquid hydrocarbon feed (53.4–356 $m^3$ $H_2$ /$m^3$ feed). The hydrotreating catalyst for the beds will typically be a composite of a Group VI metal or compound thereof, and a Group VIII metal or compound thereof, supported on a porous refractory base such as alumina. Examples of hydrotreating catalysts are alumina supported cobalt-molybdenum, nickel sulfide, nickel-tungsten, cobalt-tungsten and nickel-molybdenum. Typically, such hydrotreating catalysts are presulfided.

What is claimed is:

1. A method for producing a hydrocarbon stream from a Fischer-Tropsch synthesis process, the method comprising:

a) isolating a light fraction and a heavy fraction from at least one product of the Fischer-Tropsch synthesis process;

b) removing carbon oxide containing compounds from the light fraction to yield a treated light fraction and a carbon oxide containing gaseous fraction;

c) subjecting the treated light fraction to at least one hydroprocessing step to yield an effluent; and d) separating at least one hydrocarbon stream from the effluent of the hydroprocessing step.

2. The method of claim 1, wherein the treated light fraction comprises LPG and higher boiling hydrocarbons.

3. The method of claim 2, wherein the treated light fraction comprises $C_3$ and $C_4$ components, and wherein at least 50 percent by volume of the $C_3$ and $C_4$ components in the light fraction are recovered in the treated light fraction.

4. The method of claim 2, wherein at least 70 percent by volume of the $C_3$ and $C_4$ components in the liquid synthesis product are recovered in the treated liquid fraction.

5. The method of claim 1, wherein the treated light fraction comprises less than about 500 ppm carbon oxide containing compounds.

6. The method of claim 1, wherein the treated light fraction has a boiling endpoint in the range of about 600–750° F.

7. The method of claim 1, wherein the heavy fraction has an initial boiling point within the range of about 600–750° F.

8. The method of claim 1, wherein at least 75% v/v of the carbon oxides present in the light fraction are recovered in the carbon oxide containing gaseous fraction.

9. The method of claim 1, wherein the carbon oxide containing gaseous fraction comprises greater than about 50 percent by weight carbon oxide containing compounds.

10. The method of claim 1, wherein the carbon oxide containing gaseous fraction comprises less than about 15 percent by weight $C_2$–$C_4$ hydrocarbons.

11. The method of claim 1, wherein the heavy fraction is subjected to hydroprocessing to yield a heavy effluent.

12. The method of claim 11, wherein at least a portion of the heavy effluent is combined with at least a portion of the treated light fraction such that the portion of the heavy effluent in the resulting blend may be subjected to at least one additional hydroprocessing step.

13. The method of claim 1, wherein at least a portion of the treated light fraction is combined with at least a portion of the heavy fraction to yield a blend that is subjected to a hydroprocessing step.

14. The method of claim 13, wherein the hydroprocessing step is selected from the group consisting of hydrocracking and hydrotreating.

15. The method of claim 13, wherein the blend that is subjected to a hydroprocessing step is further subjected to a separation step that yields at least one fuel product.

16. The method of claim 13, wherein the blend that is subjected to a hydroprocessing step is further subjected to a separation step that yields at least one heavy product.

17. The method of claim 16, wherein at least a portion of the at least one heavy product is subjected to a second hydroprocessing step.

18. The method of claim 16, wherein at least a portion of the at least one heavy product is further hydroprocessed to prepare a lubricating oil base stock.

19. The method of claim 1, wherein the step that comprises removing carbon oxide containing compounds from the light fraction is performed by contacting the light fraction with a stripping medium in a separation zone of a reactor.

20. The method of claim 1, wherein the hydrocarbon stream that is separated from the effluent of the hydroprocessing step yields at least one fuel product.

21. The method of claim 20, wherein the at least one fuel product is a diesel fuel.

22. The method of claim 1, wherein the separation step that separates at least one hydrocarbon stream from the effluent of the hydroprocessing step comprises a distillation step.

23. The method of claim 22, wherein the distillation step is conducted at a pressure of greater than about 5 bar.

24. The method of claim 1 wherein the step of removing carbon oxide containing compounds from the light fraction is conducted at a pressure of greater than about 5 bar.

25. A method for producing a hydrocarbon stream from a Fischer-Tropsch synthesis process, the method comprising:

a) isolating a light fraction and a heavy fraction from the products of the Fischer-Tropsch synthesis process;

b) removing carbon oxide containing compounds from the light fraction to yield a treated light fraction and a carbon oxide containing gaseous fraction;

c) subjecting the treated light fraction to a hydroprocessing step;

d) combining the hydroprocessed treated light fraction with at least one portion of the heavy fraction to form a blend; and e) separating at least one hydrocarbon stream from the blend.

26. The method of claim 25, wherein the at least one hydrocarbon stream that is separated from the blend is a light hydrocarbon.

27. The method of claim 25, wherein the at least one hydrocarbon stream that is separated from the blend is a fuel product.

28. The method of claim 25, wherein the at least one hydrocarbon stream that is separated from the blend is a heavy product that may be further hydroprocessed to prepare a lubricating oil base stock.

29. The method of claim 25, wherein the separation step that separates at least one hydrocarbon stream from the blend comprises a distillation step.

30. The method of claim 25, wherein the heavy fraction is subjected to a hydroprocessing step, such that the hydroprocessed heavy fraction may be combined with the hydroprocessed treated light fraction.

31. The method of claim 30, wherein the hydroprocessing step for the treated light fraction is a hydrotreating step.

32. The method of claim 30, wherein the hydroprocessing step for the heavy fraction is a hydrocracking step.

33. The method of claim 30, wherein the combined effluent from the hydroprocessed heavy fraction and hydroprocessed treated light fraction is passed to the separation step.

34. The method of claim 25, wherein the heavy fraction is combined with the treated light fraction before the treated light fraction is subjected to the hydroprocessing step, such that the heavy fraction and the treated light fraction are hydroprocessed at the same time.

35. The method of claim 34, wherein the hydroprocessing step comprises first a hydrocracking step and then a hydrotreating step.

36. The method of claim 34, wherein the hydroprocessing step comprises first a hydrotreating step and then a hydrocracking step.

37. The method of claim 34, wherein the effluent from the hydroprocessing step is passed to the separation step.

38. The method of claim 25, wherein the heavy fraction is subjected to a hydrocracking process, and wherein the effluent from the heavy fraction hydrocracking process is combined with the treated light fraction.

39. The method of claim 38, wherein the combined hydrocracked heavy fraction and treated light fraction is passed to a hydrotreating step.

40. The method of claim 39, wherein the effluent from the hydrotreating step is passed to the separation step.

41. The method of claim 25, wherein one of the carbon oxide containing compounds that is removed from the light fraction is $CO_2$.

* * * * *